US007866172B2

(12) United States Patent
Douglas et al.

(10) Patent No.: US 7,866,172 B2
(45) Date of Patent: Jan. 11, 2011

(54) SYSTEM AND METHOD FOR CONTROLLING WORKING FLUID CHARGE IN A VAPOR COMPRESSION AIR CONDITIONING SYSTEM

(75) Inventors: Jonathan David Douglas, Bullard, TX (US); James Thomas Schaefer, Jr., Tyler, TX (US); Gregory F. Walters, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 699 days.

(21) Appl. No.: 11/486,874

(22) Filed: Jul. 14, 2006

(65) Prior Publication Data

US 2008/0011003 A1 Jan. 17, 2008

(51) Int. Cl.

| | |
|---|---|
| ***G01K 13/00*** | (2006.01) |
| ***F25B 45/00*** | (2006.01) |
| ***F25B 41/00*** | (2006.01) |
| ***F25B 49/00*** | (2006.01) |

(52) U.S. Cl. ..... 62/149; 62/129; 62/209; 62/127; 62/210

(58) Field of Classification Search ..... 62/129, 62/149, 209, 127, 210

See application file for complete search history.

(56) References Cited

U.S. PATENT DOCUMENTS

| | | | | |
|---|---|---|---|---|
| 3,992,898 | A | 11/1976 | Duell et al. | |
| 4,554,496 | A * | 11/1985 | Rudich et al. | 318/600 |
| 4,633,681 | A | 1/1987 | Webber | |
| 4,873,838 | A | 10/1989 | Voorhis et al. | |
| 5,186,021 | A | 2/1993 | Keller | |
| 5,187,942 | A * | 2/1993 | Komatsu et al. | 62/149 |
| 5,341,656 | A | 8/1994 | Rust, Jr. et al. | |
| 5,345,780 | A | 9/1994 | Aaron et al. | |
| 5,706,670 | A | 1/1998 | Voorhis | |
| 5,715,862 | A | 2/1998 | Palmer | |
| 5,836,349 | A | 11/1998 | Kimberly et al. | |
| 6,016,661 | A | 1/2000 | Sagar | |
| 6,269,840 | B1 | 8/2001 | Beaver | |
| 6,668,574 | B2 | 12/2003 | Rakowski et al. | |
| 7,472,557 | B2 | 1/2009 | Kang et al. | |
| 2003/0037553 | A1 * | 2/2003 | Sulc et al. | 62/151 |
| 2005/0132729 | A1 * | 6/2005 | Manole | 62/149 |
| 2008/0006101 | A1 * | 1/2008 | Nogami et al. | 73/865.9 |

OTHER PUBLICATIONS http://web.archive.org/web/20060502165319/http://www.air-conditioner-selection.com/evacuation-air-conditioning-system.html (published May 2, 2006).*

* cited by examiner

*Primary Examiner*—Thomas E Denion
*Assistant Examiner*—Michael Carton
(74) *Attorney, Agent, or Firm*—Conley Rose, P.C.; J. Robert Brown, Jr.

(57) ABSTRACT

Vapor compression air conditioning systems are provided with a flow restrictor for transferring working fluid to and from at least one of the compressor low pressure inlet conduit and compressor high pressure outlet conduit to provide for accurate charge adjustment to achieve predetermined fluid sub-cooling. Pressure and temperature measurements are taken at a condenser fluid outlet conduit and provided to a microcontroller for determining fluid sub-cooling and comparing sub-cooling with a predetermined target sub-cooling. A charge addition or recovery apparatus may include a solenoid valve controlled by the microcontroller to more accurately control the addition or recovery of refrigerant fluid charge.

16 Claims, 4 Drawing Sheets

SYSTEM AND METHOD FOR CONTROLLING WORKING FLUID CHARGE IN A VAPOR COMPRESSION AIR CONDITIONING SYSTEM

BACKGROUND OF THE INVENTION

Vapor compression refrigeration, air conditioning and heating (heat pump) systems have long been plagued with less than optimum operating efficiencies due to an inadequate or excessive working fluid charge within the system. Vapor compression air conditioning and heat pumps systems, for example, typically are designed to operate with a working fluid charge which provides a small amount of sub-cooling of the working fluid in its condensed state. However, initial installation, servicing and repair operations are difficult to carry out with respect to providing a proper fluid charge within the system. For example, when removing fluid or adding fluid to the system, there is often inadequate control of flow of the fluid (refrigerant) resulting in an excessive charge of fluid to a system or a system which is undercharged. Historically, it has been necessary to add or subtract fluid and operate the system to "wait and see" if the system comes into a balanced condition or achieves the desired amount of sub-cooling of the fluid in its condensed state. However, the present invention overcomes the inaccuracies and excessive delays in providing properly charged vapor compression air conditioning systems, in particular.

SUMMARY OF THE INVENTION

The present invention provides a vapor compression air conditioning (heating, cooling or both heating and cooling) or refrigeration system adapted for optimum operating efficiency with respect to the proper quantity or charge of working fluid disposed in the system. The present invention also provides a method, particularly, for adding working fluid to a vapor compression-type air conditioning or refrigeration system. However, a method of extracting fluid is also contemplated.

In accordance with one aspect of the present invention, a vapor compression air conditioning or refrigeration system is adapted for connection to a fluid adding or fluid extracting unit which may include at least one reservoir of working fluid and one or more conduits for connection to fluid conduits associated with the working fluid compressor of the air conditioning system. A fluid flow restrictor device may be provided in one or more conduits adapted to be connected to the so-called low pressure side of a compressor as well as the high pressure side for adding fluid to or removing fluid from the system circuit, respectively. The flow restrictor device may be adapted for throttling fluid flow in one direction while providing for substantially unrestricted flow of fluid in an opposite direction. The flow restrictor devices may be connected to a portable fluid adding and fluid extracting unit or the devices may be permanently connected to the working fluid conduits associated with or connected to the compressor of a vapor compression air conditioning or refrigeration system.

In accordance with another aspect of the present invention, a vapor compression-type air conditioning system or refrigeration system is adapted to include a control circuit or controller and associated instrumentation which monitors the operating condition of the system during a working fluid charge adding or extracting process to calculate actual sub-cooling of the working fluid as it leaves a condenser unit of the system. The controller is operable to provide a suitable output signal indicating the need to remove additional fluid, add additional fluid or indicate no action needed. Still further, the controller may be adapted to automatically shutoff the flow of working fluid to the system when an optimum operating or selected operating condition is reached.

In accordance with yet a further aspect of the present invention, an improved method is provided for adding working fluid to or subtracting working fluid from a vapor compression air conditioning or refrigeration system which achieves an optimum fluid charge, or at least a fluid charge providing a selected amount of sub-cooling of the working fluid flowing in the system.

Those skilled in the art will further appreciate the above-mentioned advantages and superior features of the invention as well as other important aspects thereof upon reading the detailed description which follows in conjunction with the drawings.

DETAILED DESCRIPTION OF PREFERRED EMBODIMENTS

Figure 1:
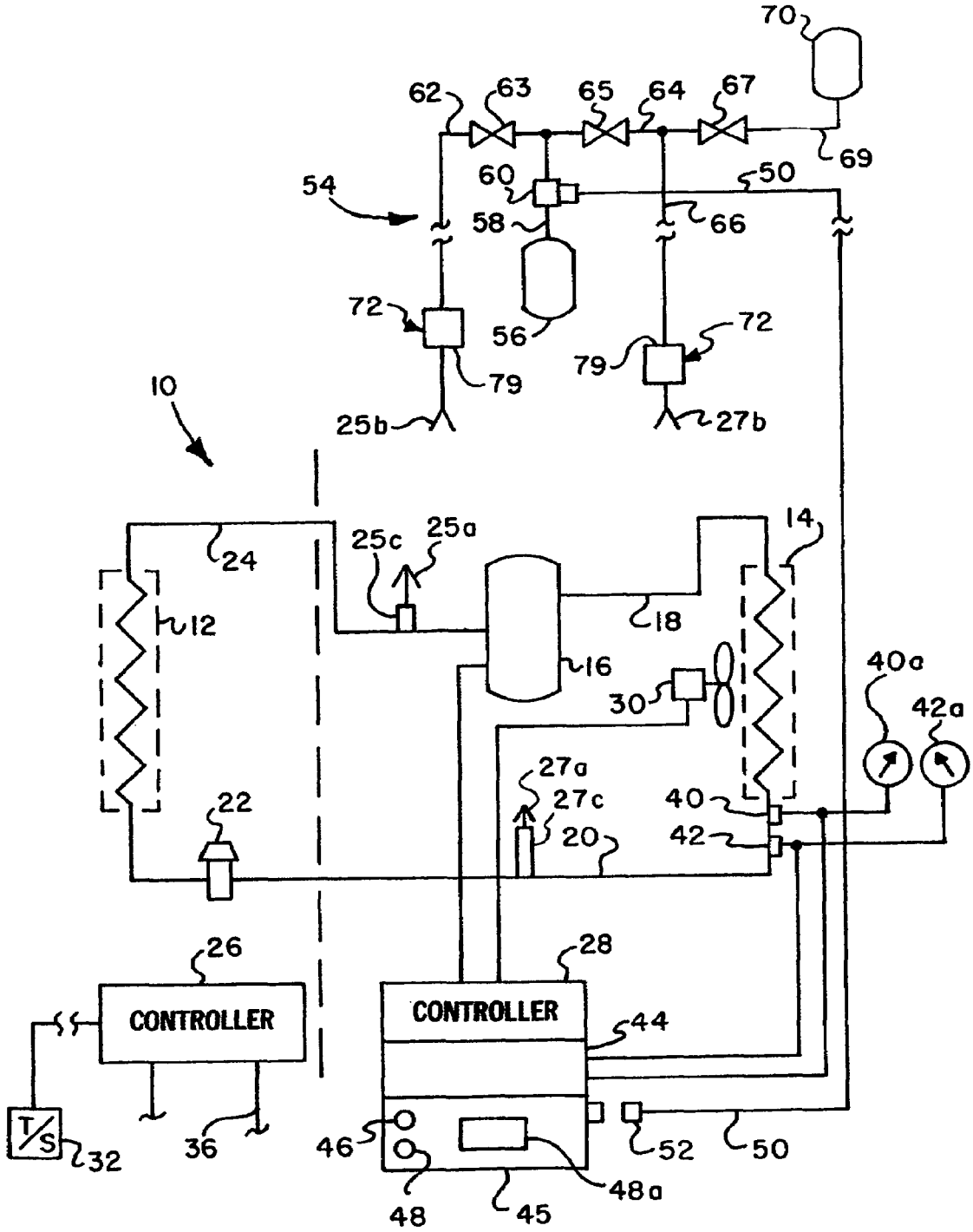
FIG. 1 is a schematic diagram of a vapor compression air conditioning system including a working fluid charge adding and evacuating unit and a controller in accordance with the invention.

In the description which follows like elements are marked throughout the specification and drawings with the same reference numerals, respectively. The drawing figures are not necessarily to scale and certain features may be shown in generalized or schematic form in the interest of clarity and conciseness.

Referring to FIG. 1, there is illustrated a schematic diagram of a vapor compression-type air conditioning system which may also be configured as a refrigeration system, and generally designated by the numeral 10. The system 10 includes respective heat exchangers 12 and 14 operably interconnected by a compressor 16. For the sake of discussion, the system 10 may be considered to be an air conditioning (cooling) system although it will be understood by those skilled in the art that the invention may be used in connection with a so called heat pump system, both reversible and nonreversible and the invention may also be used in connection with a refrigeration system used for purposes other than conditioning ambient air for human comfort or the like.

The compressor 16 is connected to heat exchanger 14 acting as a condenser by way of a high pressure discharge conduit 18 and condenser 14 is connected to heat exchanger 12, acting as an evaporator unit, by way of a further high pressure conduit 20 and an expansion device 22. Typically, the heat exchanger 12, expansion device 22 and a portion of a conduit 24 interconnecting the compressor 16 with the heat exchanger 12 are located within the interior of a structure being cooled. A system controller 26 is operably connected to certain components including an indoor fan or blower, not shown, and a second portion 28 of the controller is provided for controlling on and off operation of compressor 16 and for controlling flow of air over heat exchanger 14 by way of a motor driven fan 30. A heat exchange medium other than forced air may be used to control heat exchange by one or both of the heat exchangers 12 and 14. When used as an air conditioning or heat pump system, the system 10 also includes a thermostat 32 connected to controller units 26 and 28. Controller unit 26 is also connected to a source of electrical power via conductor means 36 and for communicating such power to controller unit 28.

Conduit 24 is considered a so-called low pressure conduit leading to compressor 16 for delivering working fluid thereto for compression to a higher pressure. Conduit 24 includes a suitable releasable connector 25*a* associated therewith disposed in proximity to the compressor 16 and including a one way poppet valve 25*c*, or so-called Schrader valve known in the art, for conducting refrigerant fluid to or from the system 10, which fluid may be one of several types known to those skilled in the art and used as the working fluid in vapor compression systems. A second releasable connector 27*a* is connected to high pressure conduit or so called liquid line 20, but may be connected to conduit 18, alternatively. Connector 27*a* includes a Schrader valve 27*c*. Conduit 18 is connected to the so-called high pressure side of compressor 16 for conducting heated vapor to heat exchanger 14 for at least partial condensation therein and then discharge to conduit 20.

Accordingly, working fluid flowing out of the heat exchanger 14 through conduit 20 to expansion device 22 is typically in liquid form and the pressure and temperature of such fluid may be sensed by respective temperature and pressure sensors 40 and 42, as shown in FIG. 1. Sensors 40 and 42 may include direct readout displays or gauges 40*a* and 42*a* and are operatively connected to a further controller unit or circuit 44 which may be operably connected to the controller unit 28 to receive power therefrom and deliver certain control signals thereto. Controller 44 may be a suitable programmable microcontroller or an application specific integrated circuit previously programmed for operation in accordance with the invention. Controller 44 includes a part 45 including visual indicators 46 and 48 for indicating the status of a refrigerant or working fluid charge in the system 10. A visual display 48*a* may also be provided for displaying information to a user. The controller part 45 is also adapted to provide an electric output signal to conductor means 50 which may be releasably connected to the controller part 45 at a plug or connector 52.

Referring further to FIG. 1, a working fluid adding and evacuation or subtracting apparatus is illustrated and generally designated by the numeral 54. The apparatus 54 includes a pressure vessel and reservoir 56 for new working fluid, such as one of the common refrigerant fluids previously mentioned. A conduit 58 is connected to reservoir 56 and to a motor operated or solenoid type valve 60 connected to conductor means 50 and to the controller part 45 via the connector 52. Conduits 62, 64 and 66 are operable to be in communication with the reservoir 56 by way of the valve 60. Suitable manual or remotely controllable valves 63, 65 and 67 may be arranged as illustrated for controlling the flow of working fluid between the new fluid reservoir 56, a fluid recovery reservoir 70 and connector parts 25*b* and 27*b* which are operable to connect the apparatus 54 to the conduit 24 and the conduit 20, respectively. Connector parts 25*a* and 27*a* are associated with Schrader valves 25*c* and 27*c* operably connected to the respective conduits 24 and 20, as illustrated and previously described. When connectors 25*a* and 25*b* are engaged, valve 25*c* is open and when connectors 27*a* and 27*b* are engaged, valve 27*c* is open.

Figure 2:
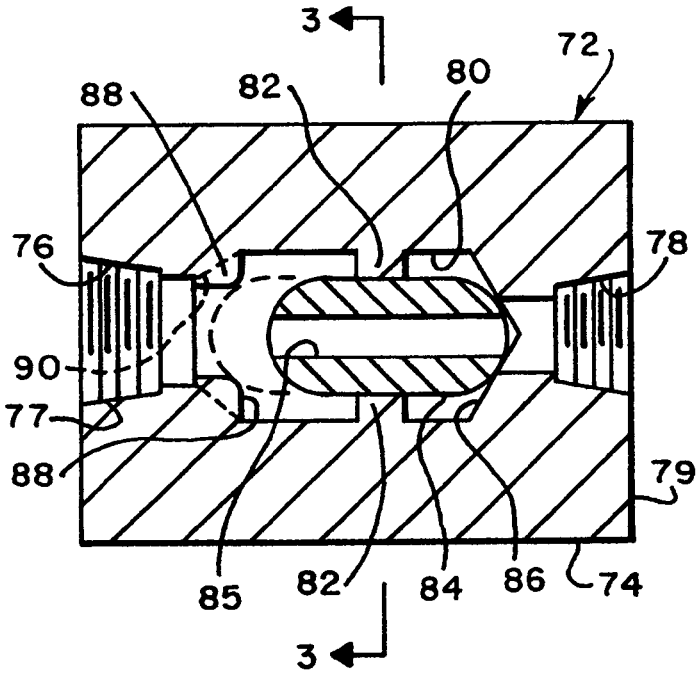
FIG. 2 is a longitudinal central section view of one preferred embodiment of a flow restrictor device in accordance with the invention and for use with the system of the invention.
Figure 3:
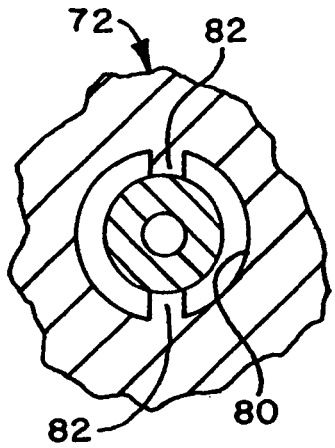
FIG. 3 is a detail section view taken generally along the line 3-3 of FIG. 2.

Referring to FIGS. 2 and 3, a flow restrictor 72 is shown in one preferred and exemplary embodiment and is characterized by a housing 74 having suitable ports 76 and 78 opening to opposed housing end faces 77 and 79, respectively. An enlarged, internal, longitudinal passage 80 is provided in housing 74 in communication with ports 76 and 78. Suitable guide bosses 82 are opposed to each other, as illustrated in FIGS. 2 and 3, for journaling a flow restrictor element in the form of a somewhat bullet-shaped movable plug or closure member 84 slidably disposed in passage 80 and operable to engage a seat 86 formed in housing 74 adjacent port 78. Plug or closure member 84 is also operable to engage internal stops 88 opposed to each other and aligned with the guide bosses 82 when the closure member moves in a direction toward the port 76. Housing 74 would normally be fabricated in two or more parts to enable insertion and removal of plug 84. A conical or tapered wall 90 remains spaced from the closure plug 84 when the plug engages the stops 88 to provide a substantially unrestricted flow path from port 78 to port 76. However, when the closure member 84 engages seat 86, flow from port 76 to port 78 is restricted and must flow through a reduced diameter passage 85 formed in the closure member 84, as shown. Alternatively, fixed orifice type flow restrictors or capillary (small diameter) tubes could be used in place of devices 72 for restricting fluid flow.

As previously mentioned, flow restrictor devices 72 may be interposed in conduits 62 and 66, as illustrated or mounted on and connected to conduits 24 and 20. One preferred arrangement for the devices 72 is to be interposed in the conduits 62 and 66, as indicated in FIG. 1, wherein when the conduit 62 is connected to the conduit 24 via connector parts 25*a* and 25*b* and Schrader valve 25*c*, flow of working fluid into conduit 24 is restricted since the closure member 84 will move to the position shown in FIG. 2 forcing working fluid to flow through the restricted passage 85 from port 76 through port 78 into conduit 24. Typically, when adding fluid to system 10 via conduit 62, valves 65 and 67 are closed and valves 60 and 63 are opened, see FIG. 1. However, if device 72 connected to conduit 62 is arranged as shown in FIG. 1, or mounted permanently on system 10 and oriented in the same direction, and it is desired to evacuate fluid from the system by way of conduit 24, for example, substantially unrestricted flow of fluid will occur since the closure member 84 will move to the left, viewing FIG. 2, allowing such unrestricted flow of fluid between ports 78 and port 76.

If it is desired to evacuate working fluid from the system 10 in the event of a fluid overcharge, conduit 66 may be connected to conduit 20 via connector parts 27*a* and 27*b* and the arrangement of the flow restrictor device 72 interposed in conduit 66 is such as to provide restricted flow of fluid from conduit 20 to conduit 66 so that control of evacuation of working fluid from the system 10 may be more closely maintained than if there was substantially no restriction to flow of fluid from conduit 20 to conduit 66. When evacuating fluid, valve 67 is opened, valve 65 or valves 60 and 63 are closed, and fluid flows from conduit 66 through valve 67 and conduit 69 to recovery reservoir 70. Accordingly, the flow restrictor devices 72 may be arranged as illustrated in FIG. 1 or may be mounted directly on the conduits 20 and 24 in the orientation shown and described for a permanent installation in the system 10. Moreover, the arrangements of the flow restrictor devices 72 may be reversed if desired to provide flow restriction in one direction of flow and substantially unrestricted flow in the opposite direction.

Accordingly, the devices 72, whether mounted permanently on system 10 in communication with the conduits 24 and 20, or mounted on a fluid charge adding and evacuation apparatus, such as the apparatus 54, assist in providing an improved method for adjusting the charge of working fluid in a vapor compression system, such as the system 10 or an equivalent. Thanks to the provision of the programmable controller unit 44, including part 45, a process may be carried out for adding a charge of working fluid to the system 10 or evacuating a portion of the charge of working fluid from the system 10 to provide the desired degree of sub-cooling of the fluid as it exits a heat exchanger, such as the condenser 14. By monitoring the temperature and pressure of the fluid flowing through the conduit 20, for example, restricted flow of fluid into or out of the system allows for adjusting a steady state operating condition and the desired degree of sub-cooling of the fluid.

Figure 4:
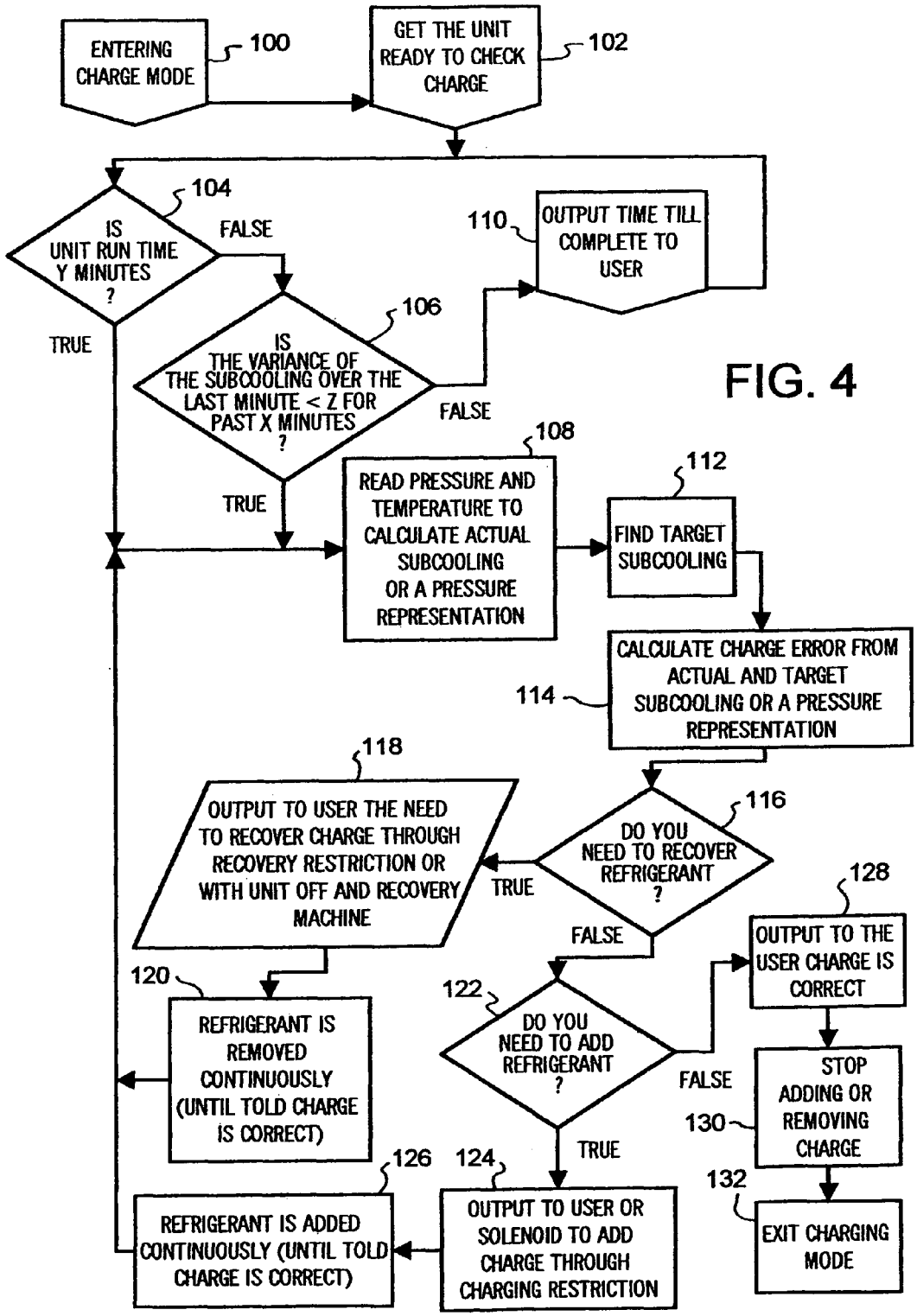
FIG. 4 is a flow diagram illustrating at least the major steps in a process for adding or subtracting working fluid with respect to a vapor compression air conditioning or refrigeration system in accordance with the invention.

In accordance with a preferred process of the present invention, the controller unit 44, 45 is operable to monitor the addition or subtraction of working fluid with respect to the system 10 by causing the controller to enter the so-called charging mode at step 100, see FIG. 4. At step 102 the controller 44, 45 and system 10 are caused to become ready to check the charge condition by querying whether or not the system has been running more than a preset period of time, such as "y" minutes indicated at step 104. If the system 10 has been running less than a preset period of time and the variance of sub-cooling of the fluid, as measured by the sensors 40 and 42, is less than a "z" predetermined amount for "x" predetermined period of time, as measured at step 106, or if the run time at step 104 is greater than the preset period of time, the process proceeds to step 108. If steps 104 and 106 are both "false", the process repeats itself as indicated by step 110 and a signal may be provided to the user indicating time to complete the process.

At step 108, controller unit 44, 45 reads the fluid pressure and temperature and calculates the actual fluid sub-cooling or a pressure representation thereof. The process proceeds to step 112 to determine if the actual sub-cooling of the working fluid is greater than or less than a so-called target sub-cooling condition and a charge error is calculated at step 114. If the charge error indicates excessive sub-cooling at step 116, a suitable indicator is illuminated, such as one of the indicators 46 or 48, or a message is provided at visual display 48*a*, indicating the need to reduce the charge of working fluid in the system 10, as indicated at step 118. Such may be carried out by pumping fluid or allowing the bleeding of fluid through device 72 connected to conduit 66 for recovery into the reservoir 70. Thanks to the restriction of fluid flow through the device 72 connected to conduit 66 the rate of change of sub-cooling can be closely monitored. In fact, as the process continues to monitor removal of fluid until the total charge is correct at step 120 and the process repeats itself, the controller 44 may generate a suitable control signal or a visual or audible signal.

However, if it is determined at step 116 that recovery or evacuation of working fluid from system 10 is not required but addition of fluid is required, such as indicated at step 122, controller unit 44 may energize valve 60, FIG. 1, for example, causing same to open and to allow fluid to flow from pressure vessel or reservoir 56 through conduit 62 and device 72 at a restricted flow rate to add working fluid to system 10 via valve 25*c* and conduit 24 until the total fluid charge is correct, as measured by the amount of sub-cooling at sensors 40 and 42 and monitored by controller 44, 45. Steps 124 and 126 reflect this process.

If no addition of working fluid is required at step 122, a suitable indicator is illuminated, such as indicator 46, or a message is displayed at display 48*a* at step 128 advising the operator or user to cease adding fluid to or removing fluid from the system 10, as indicated at step 130. The process is then completed as indicated at step 132. Operation of the valves 63, 65 and 67 to allow flow of fluid between reservoirs 56 and 70 and the system 10, as required by the process described above, is believed to be within the purview of one skilled in the art.

Figure 5:
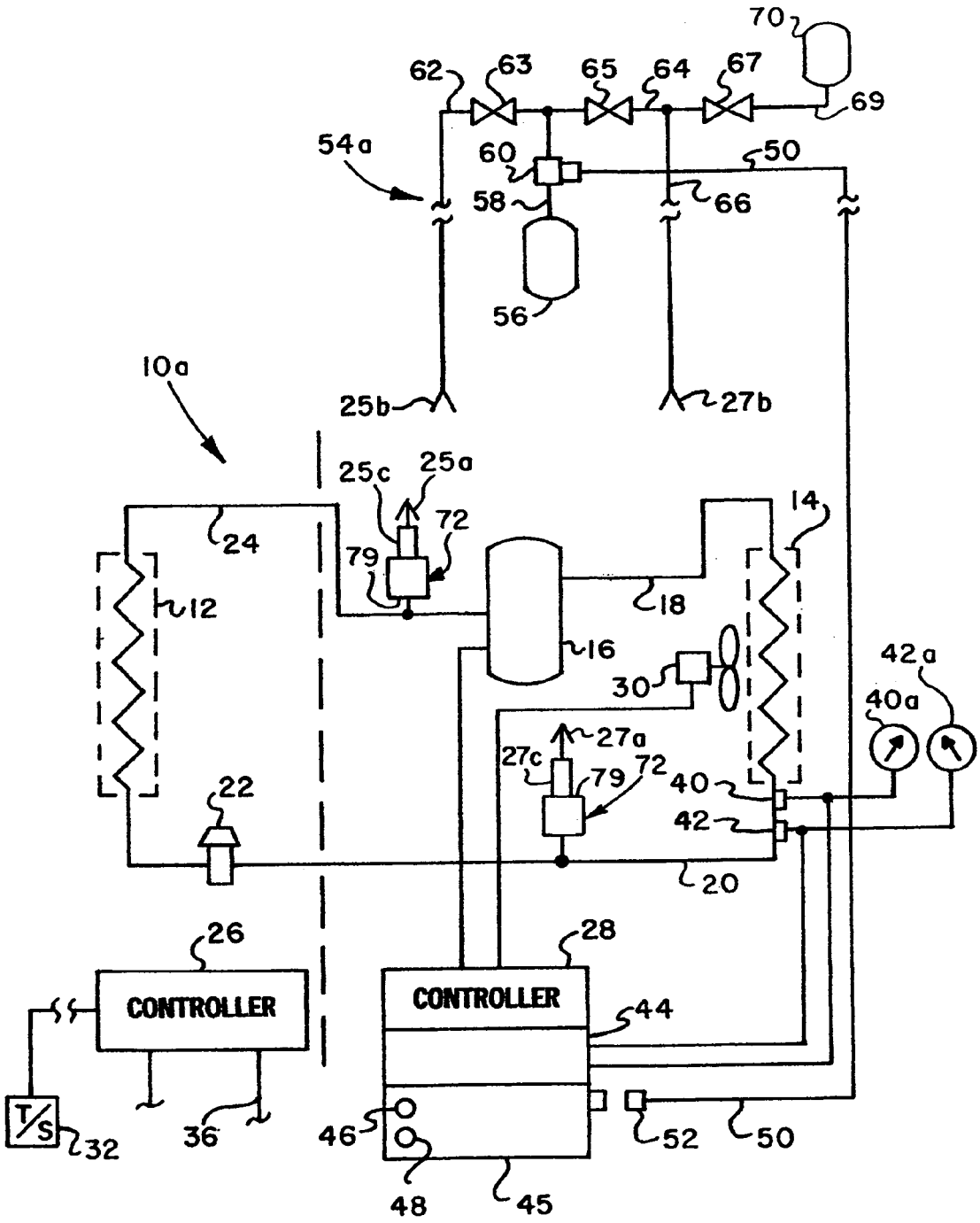
FIG. 5 is a schematic diagram of an alternate embodiment of a system in accordance with the invention.

Referring briefly to FIG. 5, a system 10*a*, illustrated schematically, is substantially like that shown and described with regard to FIG. 1 with the exception that the devices 72 are essentially permanently mounted to the system in communication with the conduits 24 and 20 in the manner illustrated whereby restricted flow of fluid into the system 10*a* is provided by the device 72 connected to conduit 24 but substantially unrestricted flow out of the system may be provided when the connector 25*a* is connected to a modified charge addition or evacuation apparatus 54*a*, for example. In like manner restricted flow of fluid out of the system 10*a* may be provided by the so-called permanent connection between a device 72 and conduit 20 for purposes of fluid evacuating at a controlled or restricted rate from the system if an overcharge, and consequent excessive sub-cooling, is occurring.

In the arrangement of FIG. 5, a charge addition and subtraction apparatus 54*a* may be connected to either connector 25*a* or 27*a* and the aforementioned check valves or so-called Schrader valves 25*c* and 27*c* may be interposed the respective connectors 25*a* and 27*a* and the devices 72, as shown in FIG. 5. The valves 25*c* and 27*c* are, of course, held open by the connectors 25*a*, 25*b* and 27*a*, 27*b* when such are engaged in a known manner. In all other respects the system 10*a* and the charge addition or evacuation apparatus 54*a* are substantially like the system 10 and apparatus 54.

Accordingly, in accordance with the systems and process described above, vapor compression air conditioning and refrigeration systems may be properly charged with working fluid to prevent flooding of the compressor, provide a faster method of charging and greater accuracy of obtaining the proper charge of working fluid in a system of the types described. Although preferred embodiments of a system and method have been disclosed in detail herein, those skilled in the art will appreciate that various substitutions and modifications may be made without departing from the scope and spirit of the appended claims.

What is claimed is:

1. A vapor compression air conditioning system, comprising:

a compressor, a condenser, a low pressure working fluid conduit and a high pressure working fluid conduit connected to said system in a substantially closed circuit for conducting working fluid, the high pressure working fluid conduit being connected to a working fluid discharge of the condenser, a pressure sensor connected to the high pressure working fluid conduit, the pressure sensor being configured to measure a pressure of the working fluid within the high pressure working fluid conduit, a temperature sensor connected to the high pressure working fluid conduit, the temperature sensor being configured to measure a temperature of the working fluid within the high pressure working fluid conduit, and a working fluid flow restrictor associated with at least one of said low pressure working fluid conduit and high pressure working fluid conduit, the flow restrictor comprising:

a housing;

a first end face and a second end face within the housing;

a plug movable within a passage in communication between the first and second end faces;

a seat in the housing between the plug and the second end face, wherein the seat and the plug are arranged such that when the plug engages the seat, flow from the first end face to the second end face is restricted; and the working fluid flow restrictor being configured to control flow of the working fluid between said circuit and a working fluid reservoir of a working fluid charging apparatus in response to said measured temperature and pressure of the working fluid within the high pressure working fluid conduit.

2. The system set forth in claim 1 wherein:

said flow restrictor is connected directly to at least one of said low pressure working fluid conduit and said high pressure working fluid conduit.

3. The system set forth in claim 1 including:

a conduit connected to said working fluid reservoir for one of transferring working fluid from said reservoir through said flow restrictor to said circuit and transferring working fluid from said circuit to said reservoir.

4. The system set forth in claim 1 wherein:

the working fluid reservoir is configured for transferring working fluid to said circuit and the system further comprises a separate recovery fluid reservoir for receiving fluid from said circuit.

5. The system set forth in claim 1 including:

a controller unit operably connected to said system and to a motor operated valve associated with said working fluid reservoir for controlling the flow of fluid between said working fluid reservoir and said circuit.

6. The system set forth in claim 5 wherein:

said motor operated valve is operably connected to said controller unit for receiving a signal to close when the measured temperature and the measured pressure of said working fluid in said system indicates a predetermined amount of sub-cooling of said working fluid.

7. The system set forth in claim 5:

wherein the controller unit operably connected to said system is operable to provide a signal indicating a need to one of add and remove working fluid with respect to said circuit.

8. A vapor compression air conditioning system, comprising:

a compressor comprising a low pressure working fluid inlet conduit and a high pressure working fluid discharge conduit connected to said system in a substantially closed circuit, a condenser connected to said high pressure conduit and to a condenser outlet conduit for conducting condensed working fluid therefrom, a pressure sensor connected to said condenser outlet conduit, the pressure sensor being configured to measure a pressure of the working fluid exiting said condenser, a temperature sensor connected to said condenser outlet conduit, the temperature sensor being configured to measure a temperature of the working fluid exiting said condenser, and a working fluid flow restrictor associated with at least one of said low pressure conduit, said high pressure conduit, and said condenser outlet conduit, the flow restrictor comprising:

a housing;

a first end face and a second end face within the housing;

a plug movable within a passage in communication between the first and second end faces;

a seat in the housing between the plug and the second end face, wherein the seat and the plug are arranged such that when the plug engages the seat, flow from the first end face to the second end face is restricted; and the working fluid flow restrictor being configured to control flow of the working fluid between said circuit and a working fluid reservoir of a working fluid charging apparatus in response to said measured temperature and pressure of the working fluid within the condenser outlet conduit.

9. The system set forth in claim 8 wherein:

said flow restrictor is connected directly to said at least one of said low pressure conduit and said condenser outlet conduit.

10. The system set forth in claim 8 including:

wherein the working fluid reservoir is configured to selectively transfer the working fluid to said circuit through said flow restrictor and the system further comprising a separate recovery fluid reservoir configured to selectively receive the working fluid from said circuit.

11. The system set forth in claim 8 including:

a programmable controller unit operably connected to said system and to an electrically operated valve associated with said working fluid reservoir for controlling the flow of fluid to said circuit.

12. The system set forth in claim 11 wherein:

said electrically operated valve is operably connected to said controller unit for receiving a signal to close when the measured temperature and the measured pressure of said working fluid in said system indicates a predetermined amount of sub-cooling of said working fluid.

13. A vapor compression air conditioning system, comprising:

a compressor;

a condenser connected to the compressor by a low pressure working fluid conduit;

an evaporator connected to the compressor by the low pressure working fluid conduit, wherein the compressor is between the condenser and the evaporator, wherein the condenser and the evaporator are connected via a high pressure working fluid conduit, and wherein the compressor, condenser, evaporator, low pressure working fluid conduit, and high pressure working fluid conduit together form a substantially closed circuit for conducting working fluid;

an apparatus configured to add or subtract working fluid from the substantially closed circuit, wherein the apparatus comprises:

a first reservoir configured to store additional working fluid;

a second reservoir configured to recover working fluid, wherein the first and second reservoirs are connected by a working fluid conduit;

a plurality valves connected to the working fluid conduit;

a first connector connecting the apparatus to a second connector in the low pressure working conduit between the compressor and the evaporator; and a third connector connecting the apparatus to a fourth connector in the high pressure working conduit between the condenser and the evaporator;

a first flow restrictor connected between the apparatus and the low pressure working fluid conduit;

a second flow restrictor connected between the apparatus and the high pressure working fluid conduit;

a pressure sensor connected to the high pressure working fluid conduit between the condenser and the evaporator, the pressure sensor being configured to measure a pressure of the working fluid within the high pressure working fluid conduit;

a temperature sensor connected to the high pressure working fluid conduit between the condenser and the evaporator, the temperature sensor being configured to measure a temperature of the working fluid within the high pressure working fluid conduit; and a controller configured to change one or more of the plurality valves in the apparatus based on both a pressure sensed by the pressure sensor and a temperature measured by the temperature sensor, wherein a change in the one or more of the plurality of valves, in conjunction with the first and second flow restrictors, either causes working fluid in the first reservoir to flow into the substantially closed circuit or causes working fluid in the substantially closed circuit to flow into the second reservoir.

14. The vapor compression air conditioning system of claim 13 wherein the apparatus is detachable from the substantially closed circuit.

15. The vapor compression air conditioning system of claim 14 wherein the first flow restrictor is permanently attached to the second connector and wherein the second flow restrictor is permanently attached to the fourth connector, whereby the first and second flow restrictors are part of the substantially closed circuit.

16. The vapor compression air conditioning system of claim 14 wherein the first flow restrictor is permanently attached to the first connector and wherein the second flow restrictor is permanently attached to the third connector, whereby the first and second flow restrictors are part of the apparatus.

* * * * *